US007232375B1

(12) United States Patent
Robert et al.

(10) Patent No.: US 7,232,375 B1
(45) Date of Patent: Jun. 19, 2007

(54) SYSTEM FOR CUSTOM FITTING A GOLF CLUB TO A PLAYER

(76) Inventors: McCarthy Robert, 40 Maple Ave., Box 0, Unadilla, NY (US) 13849; Michael McCarthy, 40 Maple Ave., Box 0, Unadilla, NY (US) 13849

( * ) Notice: Subject to any disclaimer, the term of this patent is extended or adjusted under 35 U.S.C. 154(b) by 34 days.

(21) Appl. No.: 11/271,534

(22) Filed: Nov. 10, 2005

(51) Int. Cl.
*A63B 69/36* (2006.01)

(52) U.S. Cl. ..... 473/220; 473/257

(58) Field of Classification Search ..... 473/219–226, 473/257, 244, 246, 325; 434/247, 252
See application file for complete search history.

(56) References Cited

U.S. PATENT DOCUMENTS 5,390,918 A * 2/1995 Meyers et al. ..... 473/246
5,997,409 A * 12/1999 Mattson ..... 473/244
6,375,579 B1 * 4/2002 Hart ..... 473/131
6,767,291 B1 7/2004 McCarthy
7,128,657 B1 * 10/2006 McCarthy et al. ..... 473/220

* cited by examiner

*Primary Examiner*—Nini F. Legesse
(74) *Attorney, Agent, or Firm*—Mark Levy & Associates, PLLC; David L. Banner

(57) ABSTRACT

A laser-based measurement system for accurately quantifying a golfer's stance and club position. The measurement system provides accurate linear and angular measurements. From data gathered by the measurement system, a golf club optimized for the golfer's natural stance may be modeled and evaluated. An adjustable club having adjustability in the fourth and fifth axes provided by spherical joints is provided to model a presumed optimal club. The golfer's performance using the modeled, optimized club may be evaluated. Finally, a fixture is provided for accurately customizing a golf club along all of the six axes.

13 Claims, 6 Drawing Sheets

SYSTEM FOR CUSTOM FITTING A GOLF CLUB TO A PLAYER

FIELD OF THE INVENTION

The invention pertains to golf clubs and putters and, more particularly, to a system for analyzing a golfer and custom fitting a golf club or putter to the golfer.

BACKGROUND OF THE INVENTION

While golf is a purely recreational endeavor for many, it is serious business for a number of people including professional players and serious amateurs. These people may make large expenditures of time, money, and effort to find one or more golf clubs or putters that work well for them. Every golfer has his favorite putter, for example, used to guide the ball into the hole. Putters come in many sizes and shapes to accommodate the individual tastes and preferences of the sports enthusiast. Putters of the prior art, when modified, have typically been customized in one or perhaps two of six possible dimensions (i.e., axes).

Heretofore, a golfer has had to find a putter he or she liked and then had to change the stance, stroke, or some other aspect of their game to accommodate the nuances of the chosen club.

In golf, putting is a particularly difficult task at best, and sometimes a seemingly impossible feat. Every golfer has experienced those days when the ball just does not fall into the cup. It is at these moments that most golfers wish to have additional help. The fact is, however, that the motion of a golf ball is controlled by Newton's three laws of motion. A properly controlled swing of a golf club results in the desired speed and direction of the ball.

Golfers usually concentrate upon or at least take into account the break and speed of the green when putting. Their attention is focused mainly upon the trajectory or path that the ball is to travel to the cup. The golf club head must strike the ball at a 90° angle to the intended direction of travel thereof. Some golf putters have a line or groove drawn along the center of the top of the club head, in order to provide an indicator that will align the club face with the ball, and point to the direction of the cup. It has long been known that a golfer's head must be aligned with his or her club face to ensure proper direction of the struck ball. Lines, grooves, or other similar devices provide the golfer help in aligning his or her head in the X and Y axes. Such alignment aids have been found to improve a golfer's putting accuracy. Although this can be a useful visual aid, such golf club markings are often prohibited by rules of golf associations, such as the United States Golf Association (USGA).

It has also been found that alignment in the fourth and fifth axes provides further improvement in a golfer's putting accuracy. Fourth, fifth, and sixth axes are defined as rotation axes around the well known X, Y, and Z-axes of the Cartesian coordinate system, respectively. These definitions are especially well known to people skilled in computer aided design (CAD) and the machining arts.

The present invention provides a system and method whereby a golfer's natural and/or preferred stance may be accurately quantified. From this quantification, a custom club or putter may be constructed so that the golfer's stroke is optimized when he or she is in most natural, comfortable position.

SUMMARY OF THE INVENTION

In accordance with the present invention, there is provided a laser-based measurement system for accurately quantifying a golfer's stance. The measurement system provides accurate linear and angular measurements. From data gathered by the measurement system, a golf club optimized for the golfer's natural stance may be modeled and evaluated. An adjustable club having adjustability in the fourth and fifth axes provided by spherical joints is provided to model a presumed optimal club. The golfer's performance using the modeled, optimized club may be evaluated. Finally, a fixture for accurately customizing a golf club along all of the six axes is provided.

It is, therefore, an object of the invention to provide a measurement and analysis tool whereby a golfer's natural, preferred stance may be quantified.

It is another object of the invention to provide a measurement and analysis tool projecting a grid of parallel, spaced-apart, laser-generated lines.

It is a further object of the invention to provide a measurement and analysis tool projecting at least one selectively rotatable laser-generated line.

It is an additional object of the invention to provide a measurement and analysis tool wherein the angle of the selectively rotatable laser-generated line may be accurately measured.

It is yet another object of the invention to provide a measurement and analysis tool projecting at least one selectively positionable spot beam.

It is a still further object of the invention to provide a measurement and analysis tool wherein spacing between parallel projected laser-generated lines may be changed.

It is another object of the invention to provide a software analysis tool to translate measurements made with projected laser-generated lines into specific dimensions for a golf club.

It is a further object of the invention to provide a measurement and analysis tool including an adjustable golf club adjustable along at least the fourth and fifth axes.

It is another object of the invention to provide a measurement and analysis tool whereby a golfer's stroke using the adjustable golf club, optimized using measured data, may be analyzed.

It is an additional object of the invention to provide a measurement and analysis tool to provide a fixture for accurately custom manufacturing a golf club having optimized dimensions along at least the fourth and fifth axes.

BRIEF DESCRIPTION OF THE DRAWINGS

A complete understanding of the present invention may be obtained by reference to the accompanying drawings, when considered in conjunction with the subsequent, detailed description, in which.

DETAILED DESCRIPTION OF THE PREFERRED EMBODIMENT

The present invention provides several components that, working together, create the ability to manufacture truly custom golf clubs and putters. For the sake of efficiency, the term putter will be used hereafter to refer to any golf club as well as putters, per se. Each portion of the system is described in detail.

Figure 1A:
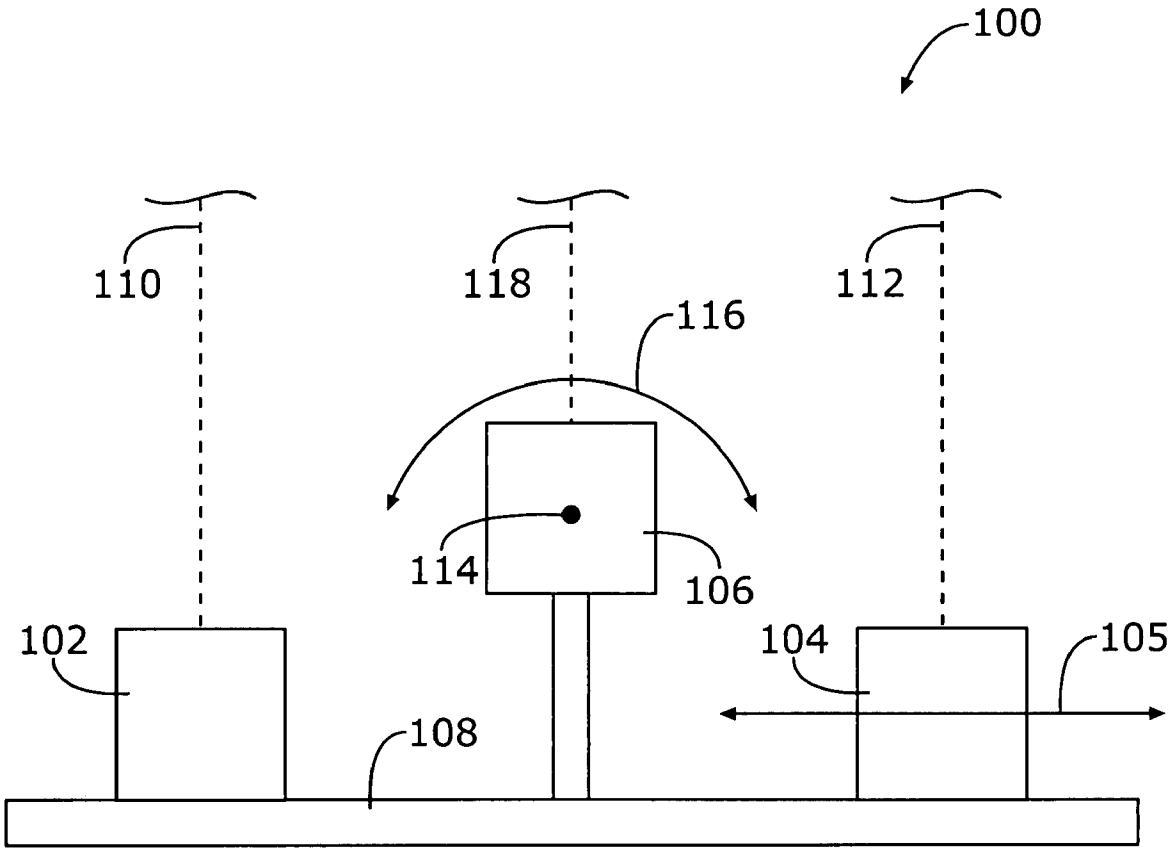
FIG. 1*a* is a rear, elevational schematic view of a laser-based measurement system in accordance with the invention.

Referring first to FIG. 1*a*, there is shown a rear, elevational, schematic view of a laser-based measuring tool 100 used for quantifying a golfer's natural stance. A first laser 102 and a second, movable laser 104 are supported on a horizontal support 108. Second, movable laser 104 is movable left-to-right and vice versa (arrow 105) along horizontal support 108 to vary the distance between first laser 102 and second, movable laser 104. Laser 104 may be suitably clamped at any desired position along horizontal support 108. Each of first laser 102 and second, movable laser 104 is adapted to project a line laser beam 110, 112, respectively, forward therefrom and perpendicular to horizontal support 108. Line laser beams 110, 112 are parallel to each other. While only a single movable laser 104 has been chosen for purposes of disclosure, it will be recognized that both lasers 102 and 104 may be made movable left-to-right along horizontal support 108.

A third, rotatable laser 106 is provided, typically positioned between first laser 102 and second, movable laser 104. Third, rotatable laser 106 is free to rotate around an axis 114 as indicated by line 116. Third, rotatable laser 106 also projects a line laser beam 118 forward therefrom and perpendicular to horizontal support 108, line laser beam 118 being substantially parallel to line laser beams 110 and 112. Third, rotatable laser 106 may also be made movable left-to-right along horizontal support 108. In addition, third, rotatable laser 106 may be located in line with, forward of, or rearward of first laser 102 and second, movable laser 104.

Figure 1B:
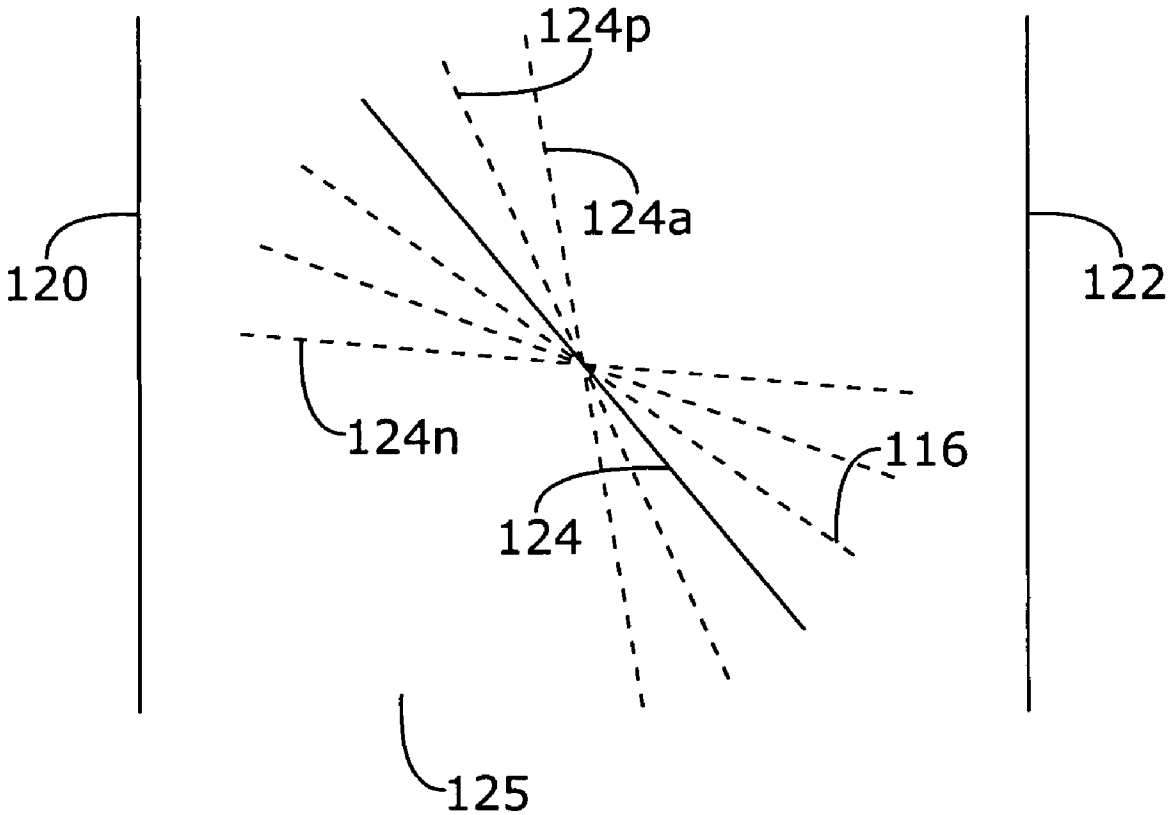
FIG. 1*b* is a schematic view of a pattern generated by the apparatus of FIG. 1*a;*

Referring now also to FIG. 1*b*, there is shown a schematic view of line laser beams 110, 112, 118 projected on a vertical surface 125. Lines 120, 122, 124 are produced by line laser beams 110, 112, 118, respectively. Line 124 may assume numerous positions indicated by lines 124*a*, 124*b*, 124*n* responsive to rotation of third rotatable laser 106 about pivot point 114.

While line laser beams 110, 112 are shown vertically aligned, it will be recognized that line laser beams 110, 112 may also be horizontally aligned by rotating one or more of lasers 102, 104 of inventive measuring tool 100 exactly 90 degrees. In alternate embodiments of the laser-measuring tool 100, the apparatus may be designed for interchangeable operation in either a vertical or a horizontal mode. Further, it will be recognized that measurement tool 100 could be adapted for simultaneous operation in both vertical and horizontal modes by adding additional lasers, not shown. Such arrangements would apparent to those of skill in the art, so further design details are not provided herein. The measuring tool 100 of the present invention can include any number of parallel, horizontal, and/or parallel vertical line laser beams. It will also be recognized that while only a single rotatable laser (i.e., third rotatable laser 106) is shown for purposes of disclosure, additional rotatable lasers may also be provided.

Line laser beams 110, 112, 118 form a laser-generated grid, not shown, that may be projected onto a golfer. The grid consists of parallel lines that may be vertical, horizontal, or a combination of the two. Because the line laser beams 110, 112, 118 are parallel, they are always the same distance apart regardless of the object on which they are projected on or how far away the target is from measuring tool 100, assuming the target is in a plane substantially parallel to horizontal support 108. Because at least second, movable laser 104 may be moved side-to-side relative to first laser 102, line laser beam 122 may be aligned on a particular portion of a golfer's body, club, ball, etc. as is described in detail hereinbelow.

Moreover, one or more laser lines 124 may be rotated to replicate any angle that a player is trying to maintain at some point in his or her swing. The angle of rotation of third, rotatable laser 106 is monitored by a digital protractor. A digital protractor found suitable for the application is provided by McMaster-Carr as their catalog number 21465A82. The digital protractor is provided with an interface allowing attachment to an external computer, not shown, where the rotation angle may be accurately monitored. It will be recognized that devices other than digital protractors may be utilized to obtain angular measurements. Such devices are believed to be well known to those of skill in the art and are not further described herein. Consequently, the invention is not limited to the digital protractor used for purposes of disclosure. Rather the invention includes any angular measurement device of sufficient angular resolution.

It will be recalled that a six-axis system is useful to describe the position of a golfer, his or her putter, and/or the ball relative to one another. The first three axes are, of course, the familiar X, Y, and Z axes of a Cartesian coordinate system. The fourth, fifth, and sixth axes are measurements of rotation around the first, second, and third axes, respectively. The combination of these six defined axes allows accurate description of any position of a golfer, his or her club, of a golf ball.

One or more "spot" lasers, not shown, described in detail in U.S. Pat. No. 6,767,291 may be used to monitor and/or analyze various body motions such as head motion, swaying, etc. These spot lasers may also be mounted in parallel combinations and, for example, focused on the ball to ascertain the velocity thereof. Techniques for making such measurements include using a digital video camera, not shown. Because the distance between the laser spots (or lines) are known, digital frames may be compared until the monitored part or condition(s) occur at a second spot. Because both the shutter speed of the camera and the number of frames that occurred between the two frames of interest are known, a velocity may be either manually or electronically calculated. In other words, because both the distance and the time are known, the velocity may be calculated.

Figure 2:
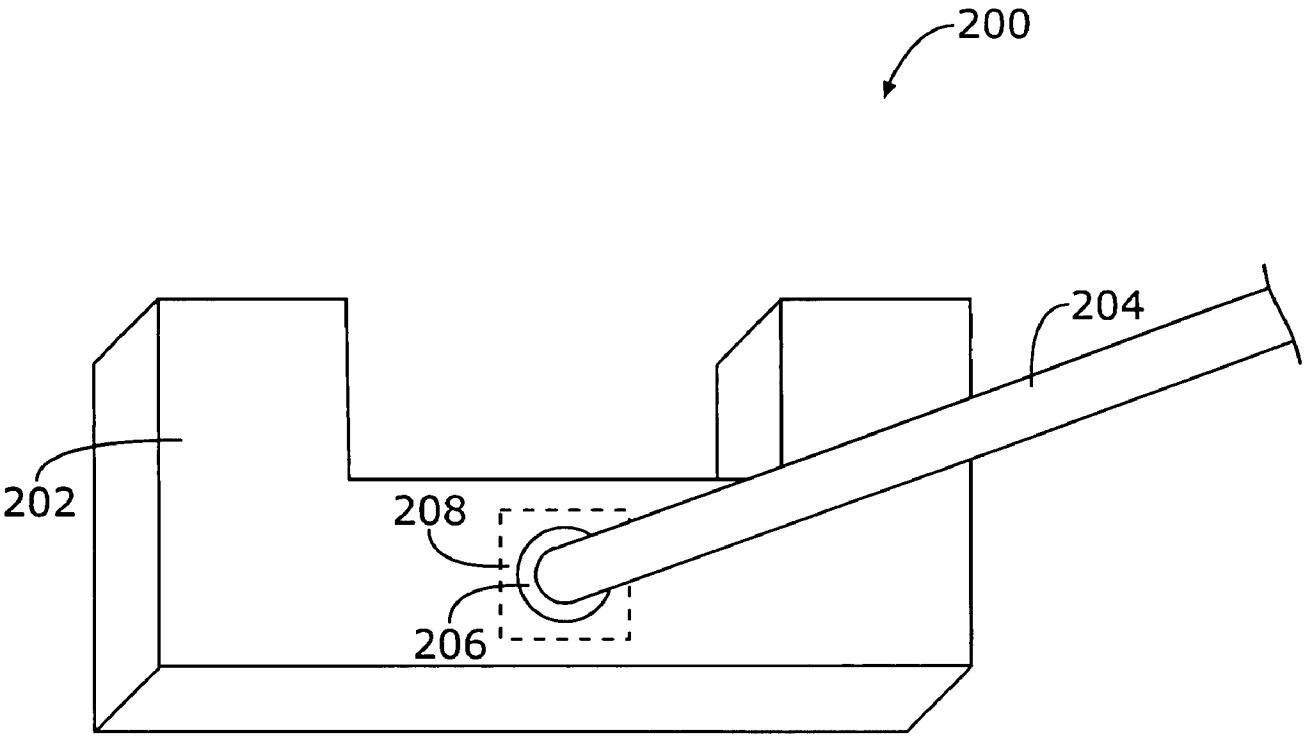
FIG. 2 is a schematic, perspective view of a portion of an adjustable golf club in accordance with the invention.

Another aspect of the analysis system of the present invention in an adjustable golf club, specifically an adjustable putter. Referring now to FIG. 2, there is shown such an adjustable putter 200 having a head 202 wherein the shaft 204 is adjustable in the fourth and/or fifth axis with respect thereto. Such adjustment may be provided by a spherical joint 206 that can be rotated to the desired angle and then locked down with a clamp or other locking mechanism 208. Such adjustment may also be provided by two perpendicular rods, not shown, one housed within the other, or other adjustable joints, not shown. It will be recognized that other methods of providing adjustability of shaft 204 in the fourth and/or fifth axis may used. Consequently, the invention is not considered limited to the adjustable joints chosen for purposes of disclosure.

The adjustable joint 206 and clamping mechanism 208 must be secure enough to withstand the shock created from hitting golf balls, not shown, with adjustable club or putter 200. Adjustable club 200 allows a player to experiment with a club that is adjustable in the fourth and fifth axis to determine what angles will optimize the club head speed and angle of attack.

Figure 3:
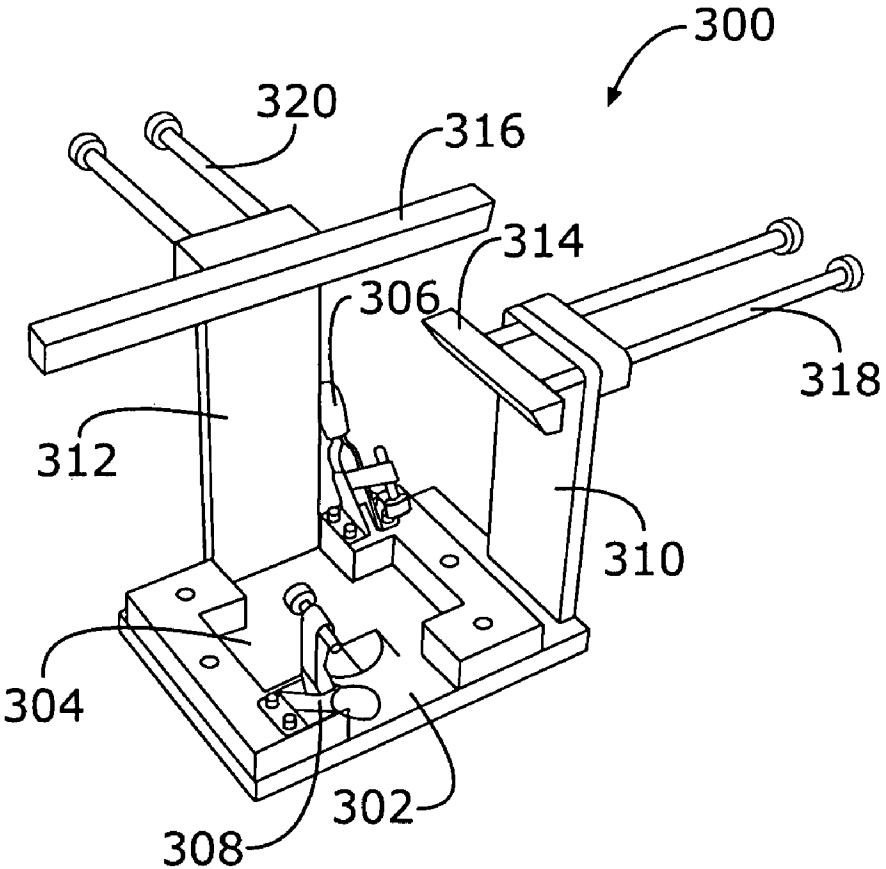
FIG. 3 is a pictorial, schematic view of a fixture used to precisely adjust the golf club of FIG. 2.

Also provided, as part of the present invention, is a calibrated jig for adjusting club or putter 200 in the fourth and fifth axis. Referring now to FIG. 3, there is shown a pictorial, perspective view of an adjustment jig, generally at reference number 300. A base plate 302 is provided with an open region 304 adapted to receive the putter head 202 (FIG. 2). Head 202 is secured to base plate 302 by clamping mechanisms 306, 308. While two clamping mechanisms 306, 308 are shown, the number and style of clamping mechanisms forms no part of the invention. Any alternative number or style of clamping mechanism may be used interchangeably.

Two upright members 310, 312 support angle indicators 314, 316, respectively. Angle indicators 314, 316 may be moved towards the center of base plate 302 by support rods 318, 320 respectively. Such movement allows angle indicators 314, 316 to be selectively positioned proximate the shaft 204 (FIG. 2) when putter 200 is placed in jig 300, thereby allowing more accurate measurement of the position of shaft 202 in at least the fourth and fifth axes.

Figure 4:
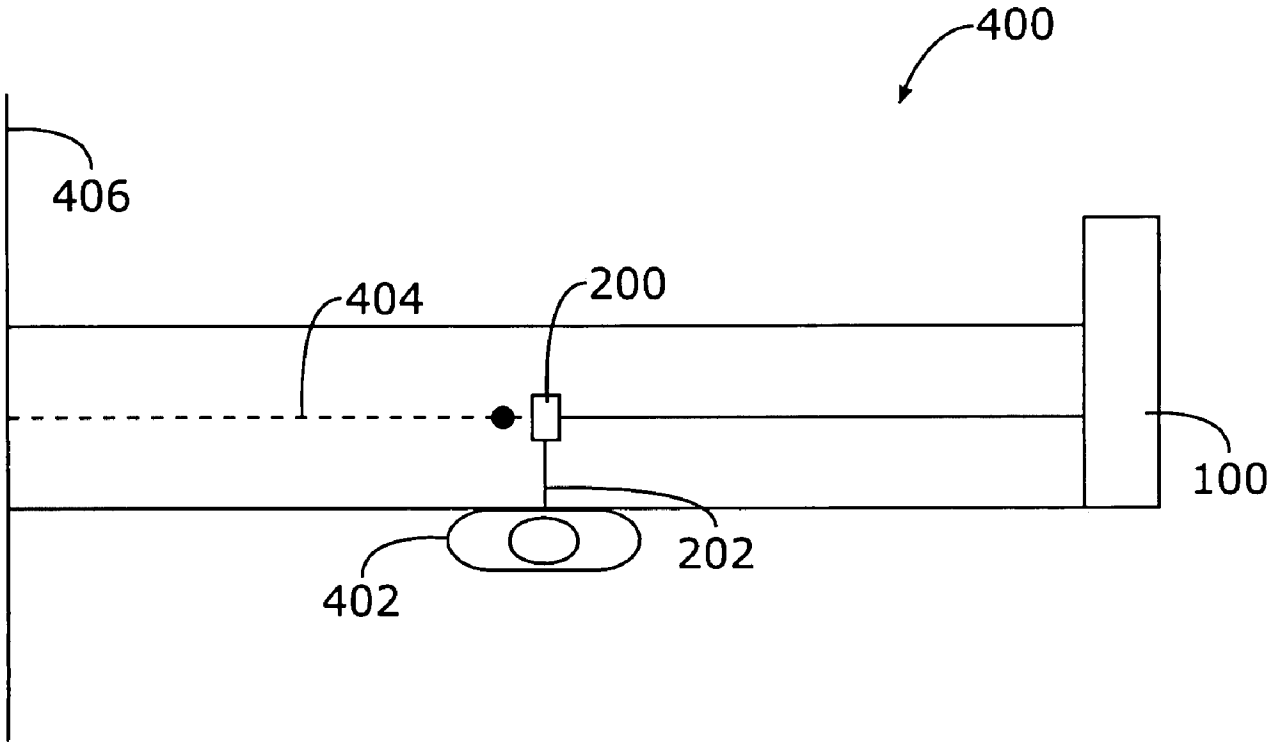
FIG. 4 is a schematic view of a first arrangement for utilizing the measurement system of FIG. 1.

Several applications of the inventive system are now provided. Fourth axis alignment of a putter is first evaluated. Referring now to FIG. 4, there is shown a top plan, schematic view of a fourth axis measurement, generally at reference number 400. Laser measuring tool 100 is positioned behind a golfer 402, generally along the line of an intended putt 404. A laser grid consisting of line laser beams 110, 112, and 118, as shown in FIG. 1*a*, is imposed over golfer 402. An optional vertical surface 406 may be used to help align the line laser beams 110, 112, and 118.

Vertical laser 112 is aligned with a ball 404. When the stance of golfer 402 is proper, his or her master eye should also be aligned with line laser beam 112. Second vertical line laser beam 110 is adjusted to fall on the shoulders of golfer 402. As it is anticipated that the hands of golfer 402 hang comfortably below the shoulders, line laser beam 110 confirms proper placement thereof.

Rotatable laser 106 (FIG. 1*a*) is adjusted until line laser beam 118 falls on shaft 202 of putter 200. Shaft 202 should run from the center of ball 404 to the hands of golfer 402. The angle of shaft 202 is readily measured by the lie angle is measured by the digital protractor, not shown, or other similar instrument or transducer. The length of shaft 202 may be measured either electronically or mechanically using a measuring tape or the like. From the information gathered in the fourth axis measurement 400, the optimum length and fourth axis alignment of shaft 202 may be accurately determined for golfer 402.

Figure 5:
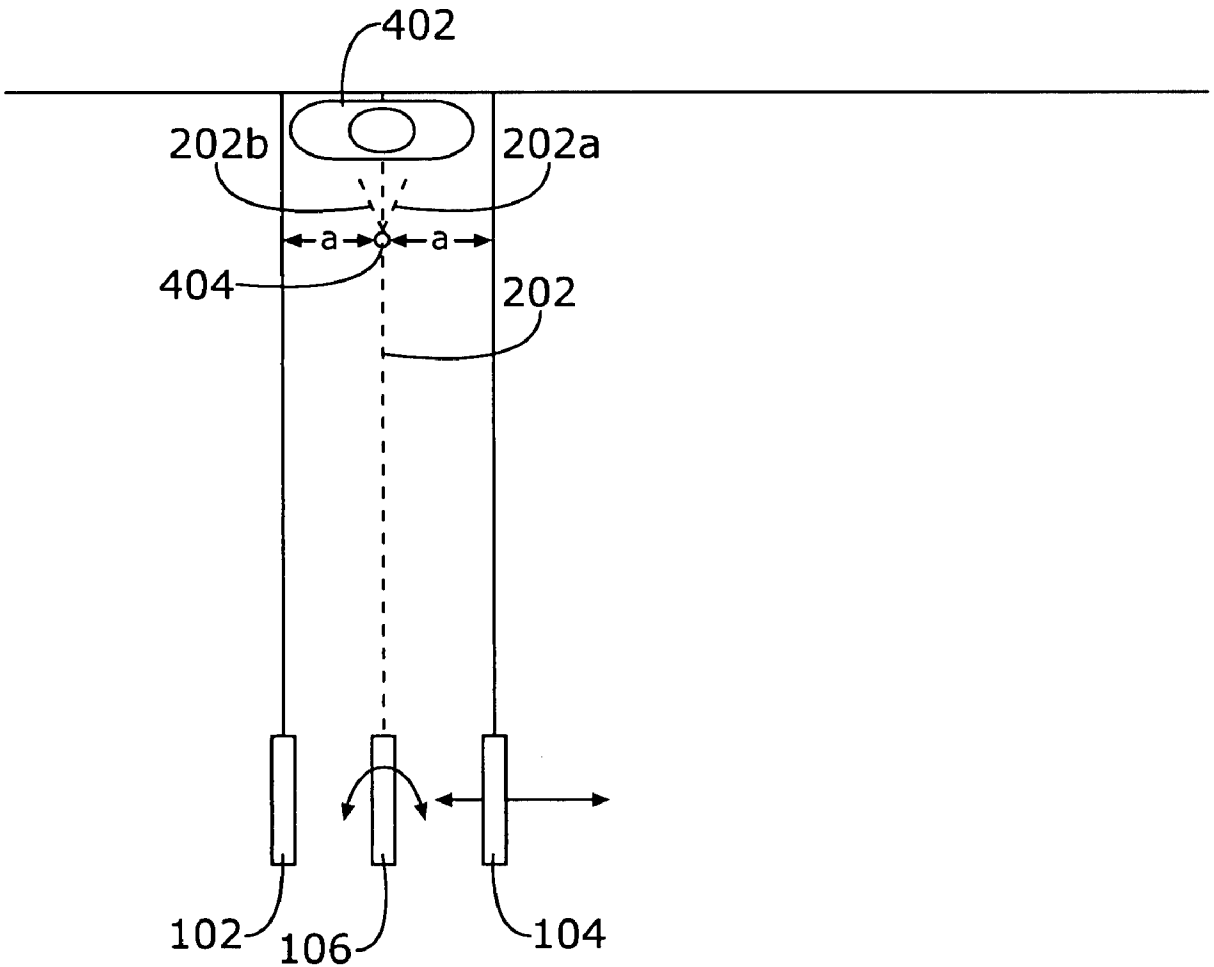
FIG. 5 is a schematic view of a second arrangement for utilizing the measurement system of FIG. 2.

Referring now to FIG. 5, there is shown another measurement setup 500 useful for determining an optimum fifth axis alignment for the shaft 202.

The laser grid is now cast upon the player 402 from the front. The third, rotatable laser 106 (FIG. 1) is adjusted to cast a vertical line at the position where shaft 204 is located as the golfer 402 addresses the ball 404. First laser 102 and second, movable laser 104 are adjusted to cast vertical lines two inches behind and ahead of ball 404, respectively. Golfer 402 is observed in his or her normal "address" position. If the shaft 204 of putter 200 is not vertical, third rotatable laser 106 is adjusted until its line beam is aligned with shaft 204. The player's stroke is then digitally recorded. The image where the ball 404 is contacted by the club face is located and isolated from other images. The angle of the shaft 204 is noted and compared to the reference position established by the line beam of third, rotatable laser 106. If the recorded angle is substantially the same as the reference angle, a putter or other club may be constructed with the fifth axis adjustment indicated by third rotatable laser 106. If, however, the recorded angle is not substantially the same as the reference angle, the digitally recorded images may be examined to ascertain the reason or reasons.

Subsequently, a putter may be constructed having a fifth axis adjustment suitable for the needs of the golfer 402. The two parallel reference line beams from lasers 102, 104 aid in setting the rotatable laser 106. Subsequently recorded strokes can be inspected to find the most efficient position (i.e., fifth axis adjustment) in accordance with a digital protractor or other angular measuring device, not shown. The results of any fifth axis adjustments may be evaluated using the laser alignment device and method described in U.S. Pat. No. 6,767,291. The putter can then be fine-tuned.

While specific procedures for evaluating fourth and fifth axis consideration are described, it will be recognized that the inventive apparatus may be used in many similar ways to evaluate virtually any characteristic of a golfer's position or the position of a golfer's club. For example, the evaluation apparatus may be modified to provide capability for projecting a combination of both vertical and horizontal line beams. When such an apparatus is placed adjacent a golfer, vertical lines (i.e., line laser beams) may be placed as desired over the ball, the hands, the hips, or the shoulders. Horizontal line laser beams may be aligned over the same points as vertical line laser beams, thereby forming crosshairs. Such crosshairs allow tracking any position of the golfer or his or her club at the moment of impact with the ball. Since the golfer's position at impact may be different from his or her position during the addressing phase of the stroke, the golfer's performance may be improved when the differences between the addressing position and the actual impact position can be minimized.

The rotatable laser may also be utilized to evaluate the golfer's spine position or other angular considerations of the putter shaft.

The many possible combinations of vertical, horizontal, and angled line laser beams allow evaluation and recording of any angle or position of the golfer's body or club.

The laser grid can be cast on a player from the front with vertical and horizontal lasers accurately monitoring different criteria. The angle of attack can be mimicked by a rotatable laser and can determine the effective loft and possibly suggest either change of equipment or even recommend custom parameters. Using the grid with various spot lasers can determine velocities of the club head at various points in the swing, possibly suggesting swing or equipment changes.

Since other modifications and changes varied to fit particular operating requirements and environments will be apparent to those skilled in the art, the invention is not considered limited to the examples chosen for purposes of disclosure and covers all changes and modifications which do not constitute departures from the true spirit and scope of this invention.

Having thus described the invention, what is desired to be protected by Letters Patent is presented in the subsequently appended claims.

What is claimed is:

1. An apparatus for evaluating a position of a golfer, comprising:

a) a first laser adapted to project a first, substantially vertical line forward therefrom;

b) a second laser adapted to project a second, substantially vertical line forward therefrom, said second vertical line being substantially parallel to and spaced apart from said first substantially vertical line; and c) a third, rotatable laser adapted to project a third line forward therefrom, said third line being selectively angularly displaced from said first and said second vertical lines.

2. The apparatus for evaluating a position of a golfer as recited in claim 1, further comprising:

d) means for selectively varying a horizontal distance between said first and said second vertical lines operatively connected to at least one of said first and said second lasers.

3. The apparatus for evaluating a position of a golfer as recited in claim 2, further comprising:

e) means for measuring an angle of rotation operatively connected to said third laser and adapted for determining said angular displacement of said third line therefrom relative to said first and said second lines.

4. The apparatus for evaluating a position of a golfer as recited in claim 3, wherein said means for measuring an angle of rotation comprises a digital protractor.

5. A method for evaluating a position of a golfer, the steps comprising:

a) providing a measurement apparatus as recited in claim 3;

b) positioning a golfer and a golf ball in a position suitable for putting said golf ball in a predetermined direction, said golfer holding a golf club comprising a shaft;

c) placing said measurement apparatus behind said golfer and aligned with a line extending from said golf ball;

d) aligning a first one of said first and said second lasers with said golf ball;

e) aligning a second one of said first and said second lasers with a body feature of said golfer; and f) aligning said third, rotatable laser to conform to said shaft of a golf club grasped and held by said golfer.

6. The method for evaluating a position of a golfer as recited in claim 5, the steps further comprising:

g) measuring at least one of the parameters: an angle of said shaft, and the length of said shaft.

7. The method for evaluating a position of a golfer as recited in claim 6, wherein said measuring step (g) comprises making a measurement of a fourth dimension parameter of said golf club.

8. The method for evaluating a position of a golfer as recited in claim 5, wherein said body feature of said golfer comprises at least one of: a shoulder, a spine, a back, an arm, a neck, a head, and an eye.

9. A method for evaluating a position of a golfer, the steps comprising:

a) providing a measurement apparatus as recited in claims 3;

b) orienting a golfer and a golf ball in a position suitable for putting said golf ball in a predetermined direction, said golfer holding a golf club comprising a shaft;

c) placing said measurement apparatus in front of said golfer and aligned substantially perpendicularly to a line extending from said golf ball;

d) aligning at least one of said first and said second lasers a predetermined distance from said golf ball; and e) adjusting said third, rotatable laser to conform to said golf club shaft grasped and held by said golfer.

10. The method for evaluating a position of a golfer as recited in claim 9, wherein said aligning step (d) comprises aligning a first one of said first and said second lasers a first predetermined distance in front of said golf ball and aligning a second of said first and said second lasers a second predetermined distance behind said golf ball.

11. The method for evaluating a position of a golfer as recited in claim 10, wherein said first predetermined distance is substantially equal to said second predetermined distance.

12. The method for evaluating a position of a golfer as recited in claim 11, wherein said first predetermined distance and said second predetermined distance are each approximately two inches.

13. An apparatus for customizing a golf club in a three-dimensional Cartesian coordinate system having a first (X) axis, a second (Y) axis, and a third (Z) axis and at least a fourth (rotation around said first axis) axis and a fifth (rotation around said second axis) axis, comprising:

a) a golf club adjustable in at least the fourth and fifth axes, comprising a head; a shaft having a proximal and a distal end, said proximal end being swivelably attachable to said head; and means for securing said shaft to said head during impact of said head with a golf ball during a stroke; and b) a fixture for receiving said adjustable golf club and comprising a scale adapted for orienting said shaft at a predetermined position in at least one of said fourth and said fifth axes.

* * * * *